US005482071A

United States Patent [19]

Liu

[11] Patent Number: 5,482,071

[45] Date of Patent: Jan. 9, 1996

[54] CRUTCH COMBINATION HAVING RESCUING TOOLS

[76] Inventor: Ching-Yuan Liu, No. 15 Alley 90, Jong-Nan South Lane, Guang-Shing Road, Tai-Ping Hsiang, Taichung County, Taiwan

[21] Appl. No.: 399,532

[22] Filed: Mar. 7, 1995

[51] Int. Cl.[6] ..... A45B 3/00

[52] U.S. Cl. ..... 135/66; 135/78

[58] Field of Search ..... 135/65, 66, 68, 135/69, 75–78

[56] References Cited

U.S. PATENT DOCUMENTS

| | | | |
|---|---|---|---|
| 422,753 | 3/1890 | Evans, Jr. | 135/77 |
| 521,342 | 6/1894 | Gaskill | 135/77 |
| 636,074 | 10/1899 | Skoog | 135/66 X |
| 1,509,157 | 9/1924 | Leano | 135/66 |
| 3,710,807 | 1/1973 | Ferry | 135/68 |
| 5,139,040 | 8/1992 | Kelly | 135/75 X |

FOREIGN PATENT DOCUMENTS

| | | | |
|---|---|---|---|
| 2023621 | 2/1992 | Canada | 135/78 |
| 0338178 | 10/1989 | European Pat. Off. | 135/78 |

*Primary Examiner*—Lanna Mai

*Attorney, Agent, or Firm*—Morton J. Rosenberg; David I. Klein

[57] ABSTRACT

A crutch includes a tube having a handle fixed on top. The handle includes a knife engaged in the tube. An extension is slidably engaged in the tube and includes an upper end adjustable relative to the tube and secured to the tube by a projection. A tool head includes a stud for engaging with the extension. The tool head may be a tip member, an axhammer or a shovel. A coupler is secured to the extension, and a quick coupler may further be engaged with the tool head so as to secure the tool head to the coupler.

5 Claims, 8 Drawing Sheets

CRUTCH COMBINATION HAVING RESCUING TOOLS

BACKGROUND OF THE INVENTION

1. Field of the Invention

The present invention relates to a crutch, and more particularly to a crutch combination having rescuing tools.

2. Description of the Prior Art

Typical crutches or canes may be used for helping walking only and may not be used for rescuing purposes.

The present invention has arisen to mitigate and/or obviate the afore-described disadvantages of the conventional crutches and canes.

SUMMARY OF THE INVENTION

The primary objective of the present invention is to provide a crutch combination which includes a number of rescuing tools.

In accordance with one aspect of the invention, there is provided a crutch combination comprising a tube including a plurality of holes formed therein and including an upper end and a lower end, a handle including a lower portion engaged in the upper end of the tube and including a knife means secured to the lower portion for engaging in the upper end of the tube, a first projection means provided in the lower portion of the handle for engaging with either of the holes of the tube so as to secure the handle to the upper end of the tube, an extension slidably engaged in the tube and including an upper end having a second projection means provided therein for engaging with either of the holes so as to secure the extension to the tube, the extension including a lower end having at least one orifice formed therein, and at least one first tool head including a stud for engaging with the lower end of the extension and including a third projection means for engaging with the orifice so as to secure the first tool head to the extension.

The first tool head may be a tip member, an axhammer or a shovel.

A coupler includes an upper end having a fourth projection means for securing the coupler to the lower end of the extension and includes a lower end having a recess formed therein, a second tool head includes an upper portion engaged in the recess and having a fifth projection means for securing the second tool head to the coupler, and a quick coupler includes a bolt engaged through the upper port ion of the second tool head and the coupler, the bolt includes a first end having a nut engaged therewith and includes a second end having a rod rotatably engaged therein, a knob is secured to the rod for rotating the rod, and a cam means is secured to the rod and rotated in concert with the rod, the cam means is engaged with the coupler when the knob is rotated so as to force the coupler against the upper portion of the second tool head and so as to secure the second tool head to the coupler.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
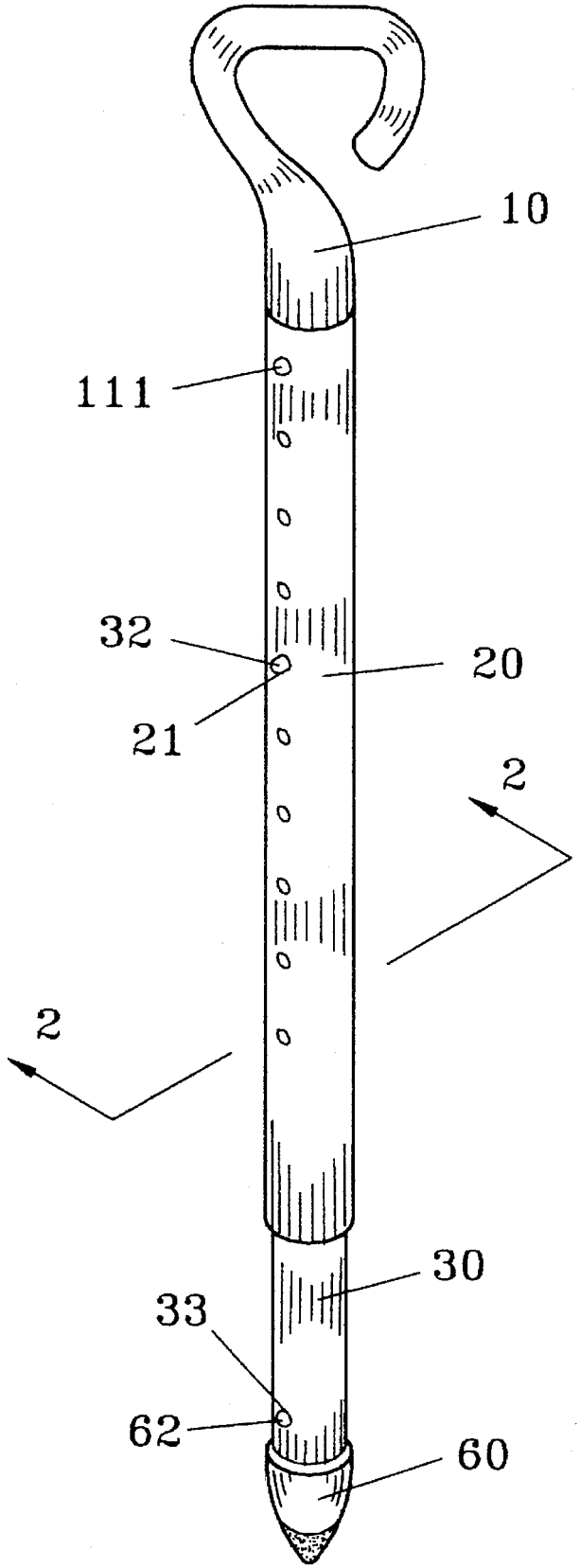
FIG. 1 is a perspective view of a crutch combination in accordance with the present invention.
Figure 2:
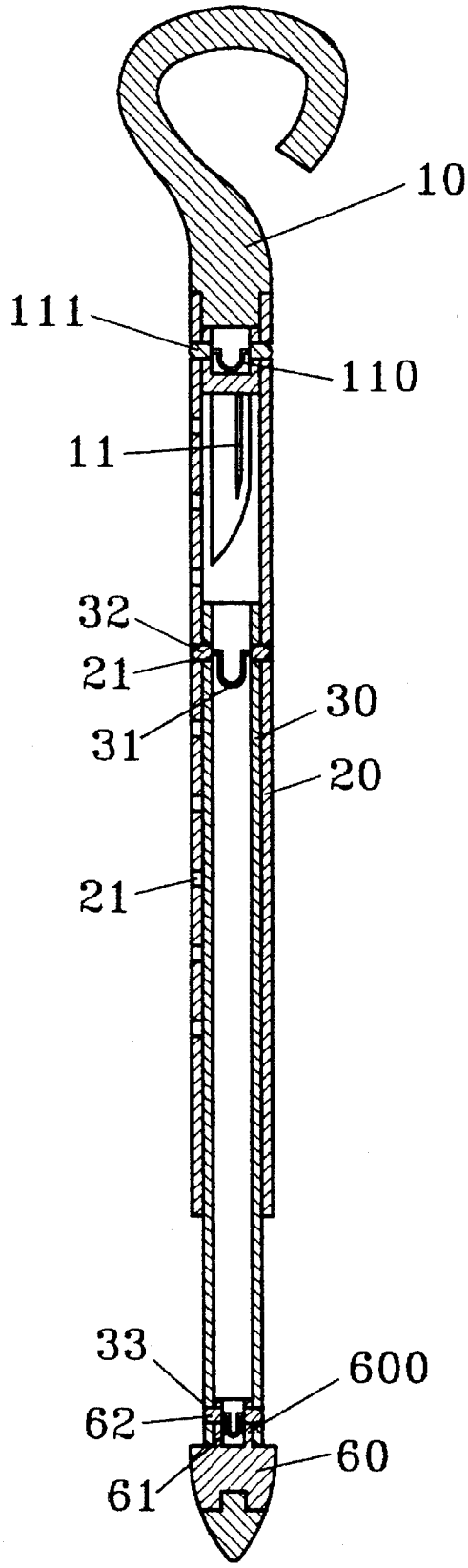
FIG. 2 is a cross sectional view taken along lines 2—2 of FIG. 1.
Figure 3:
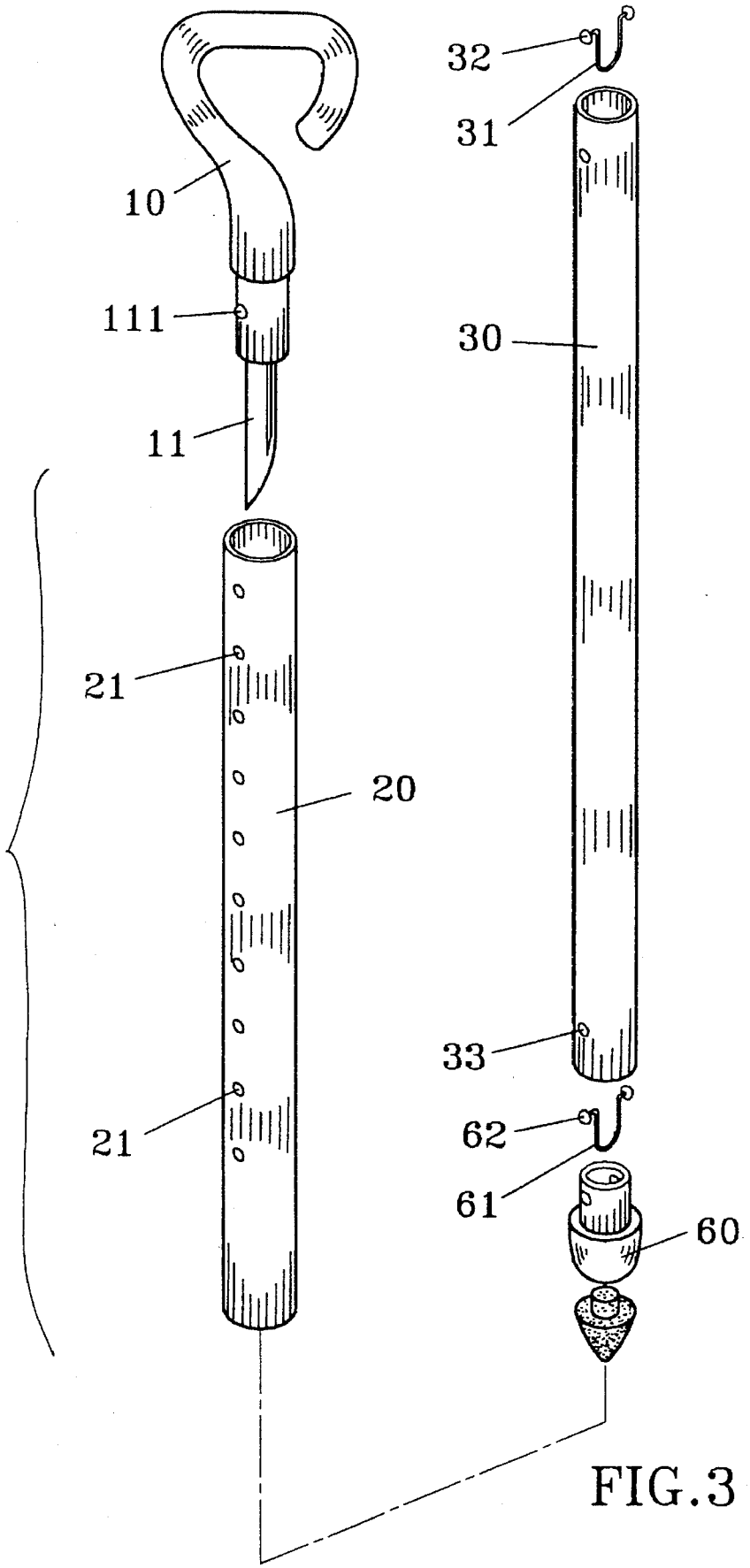
FIG. 3 is an exploded view of the crutch combination.

Referring to the drawings, and initially to FIGS. 1 to 3, a crutch combination in accordance with the present invention comprises a tube 20 including a number of holes 21 formed therein. A handle 10 is engaged on top of the tube 20, includes a knife 11 engaged in the tube 20 and includes a projection means 111 provided therein and a spring means 110 for biasing the projection means 111 to engage with the holes 21 of the tube 20 so as to secure the handle 10 to the tube 20. An extension 30 is slidably engaged in the tube 20 and includes an upper end having a projection means 32 provided therein and having a spring means 31 for biasing the projection means 32 to engage with either of the holes 21 of the tube 20. The extension 30 may be adjusted relative to the tube 20 when the projection means 32 are slightly depressed inwards of the tube 20 and when the extension 30 is pulled relative to the tube 20. A head or a tip 60 includes a stud 600 formed on one end for engaging in the bottom end of the extension 30 and includes a projection means 62 having biasing means 61 for biasing the projection means 62 to engage with the orifices 33 formed in the bottom end of the extension 30 so as to secure the head 60 to the extension 30.

Figure 4:
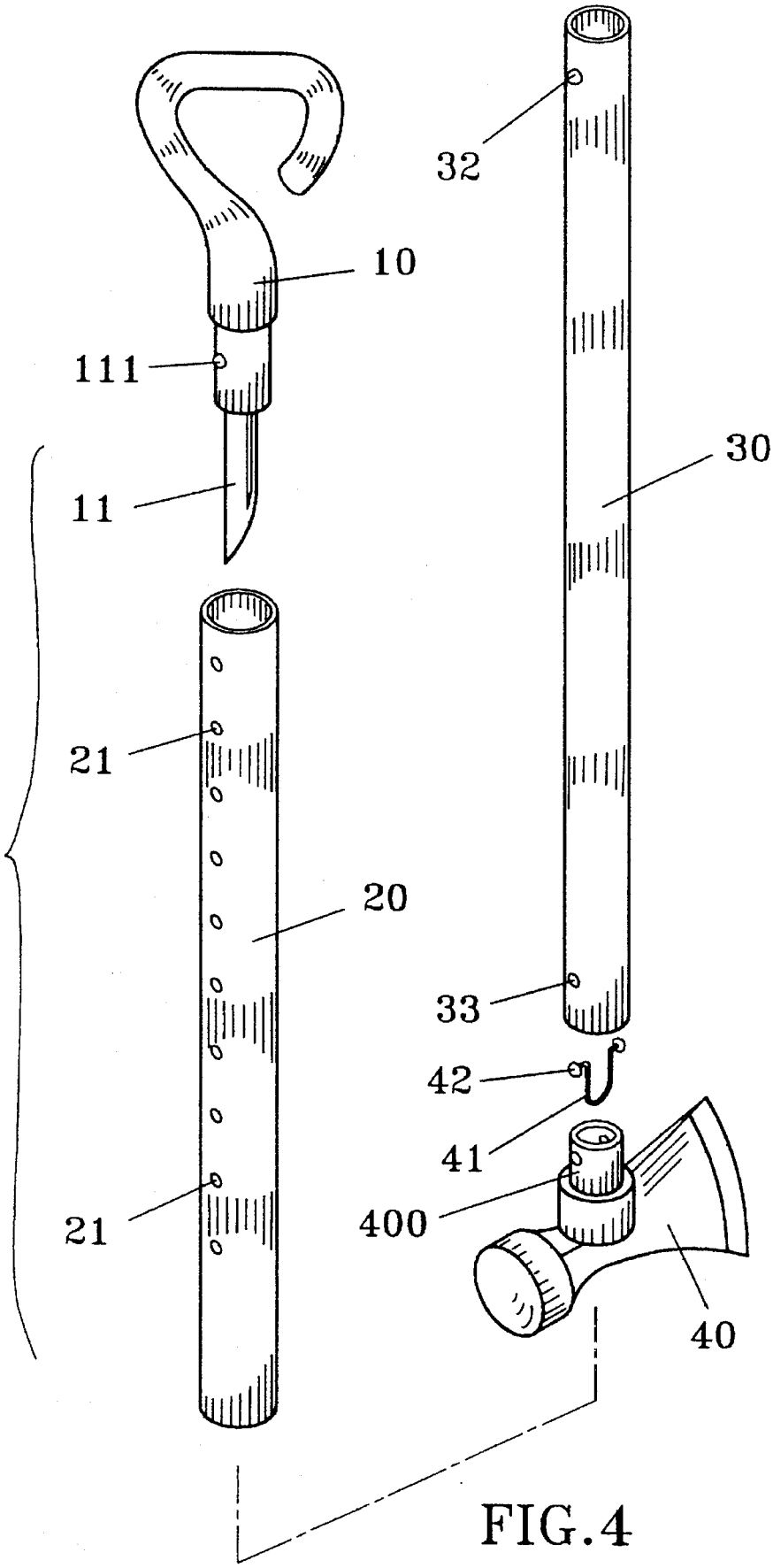

Referring next to FIG. 4, a head 40 of an axhammer includes a stud 400 for engaging in the bottom end of the extension 30 and includes a projection means 42 having biasing means 41 for biasing the projection means 42 to engage with the orifices 33 formed in the bottom end of the extension 30 so as to secure the head 40 to the extension 30.

Figure 5:
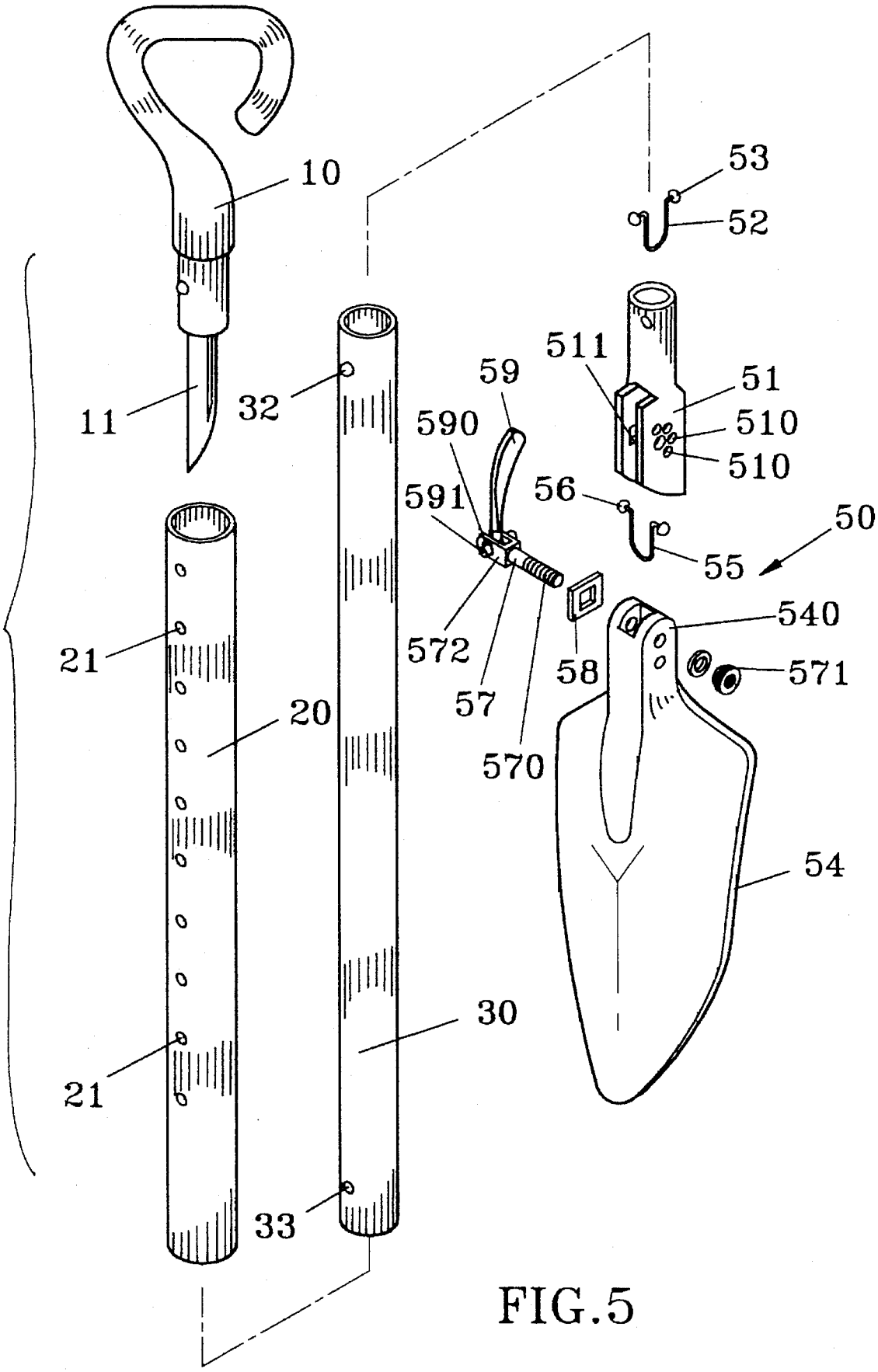
FIGS. 5 are exploded views illustrating two applications of crutch combination.
Figure 6:
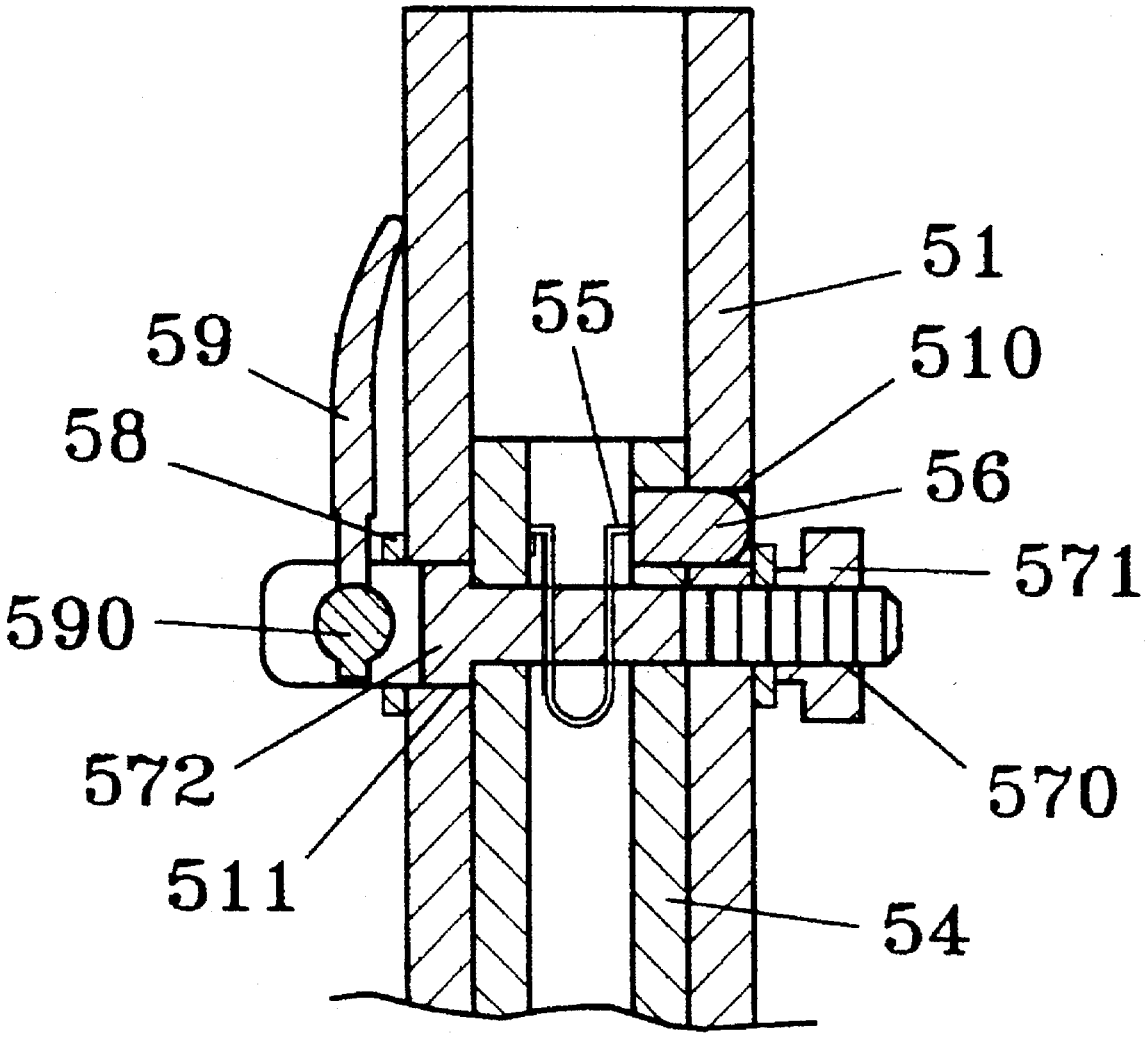
FIG. 6 is a partial cross sectional view illustrating the securing of the tool to the crutch combination and FIGS. 7 and 8 are plane schematic views illustrating the operation of the crutch combination.
Figure 7:
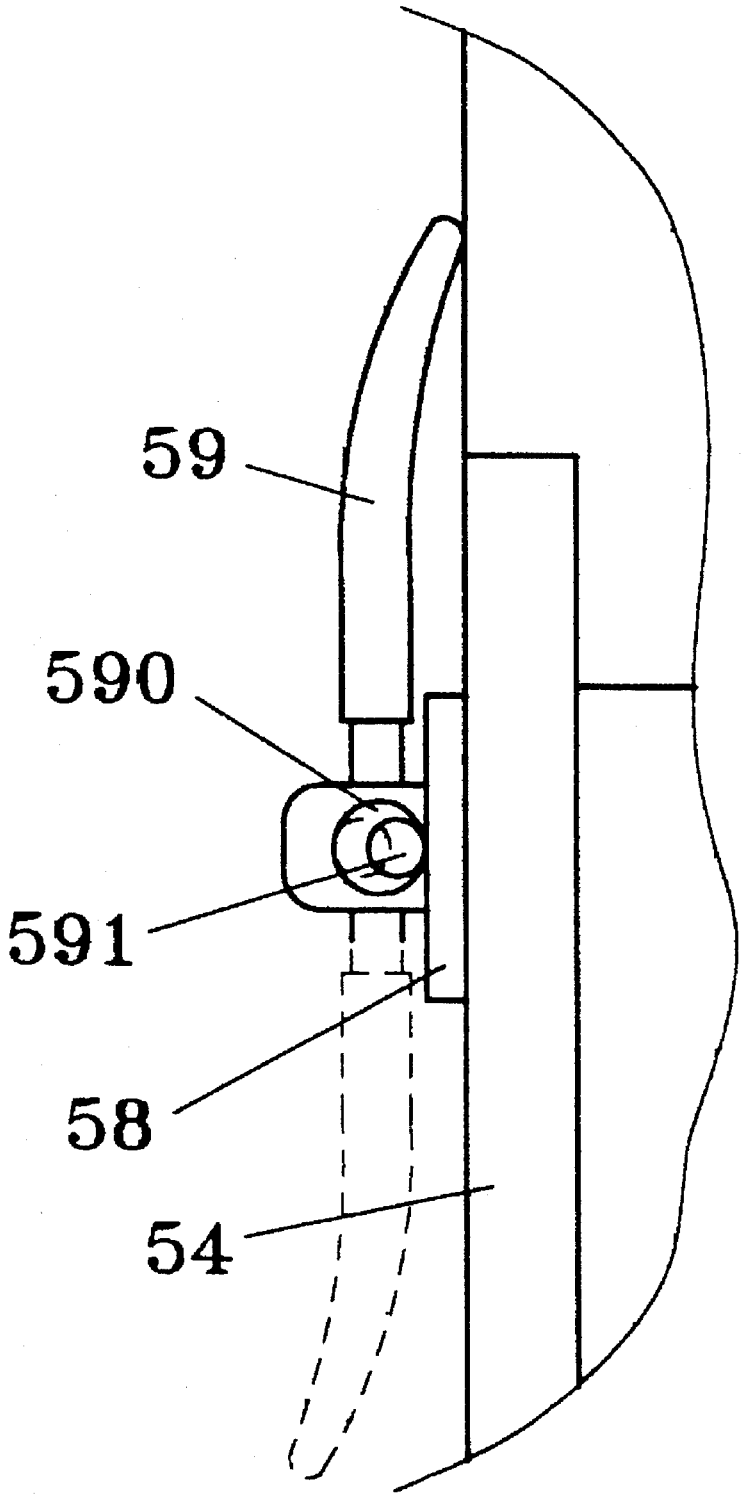
Figure 8:
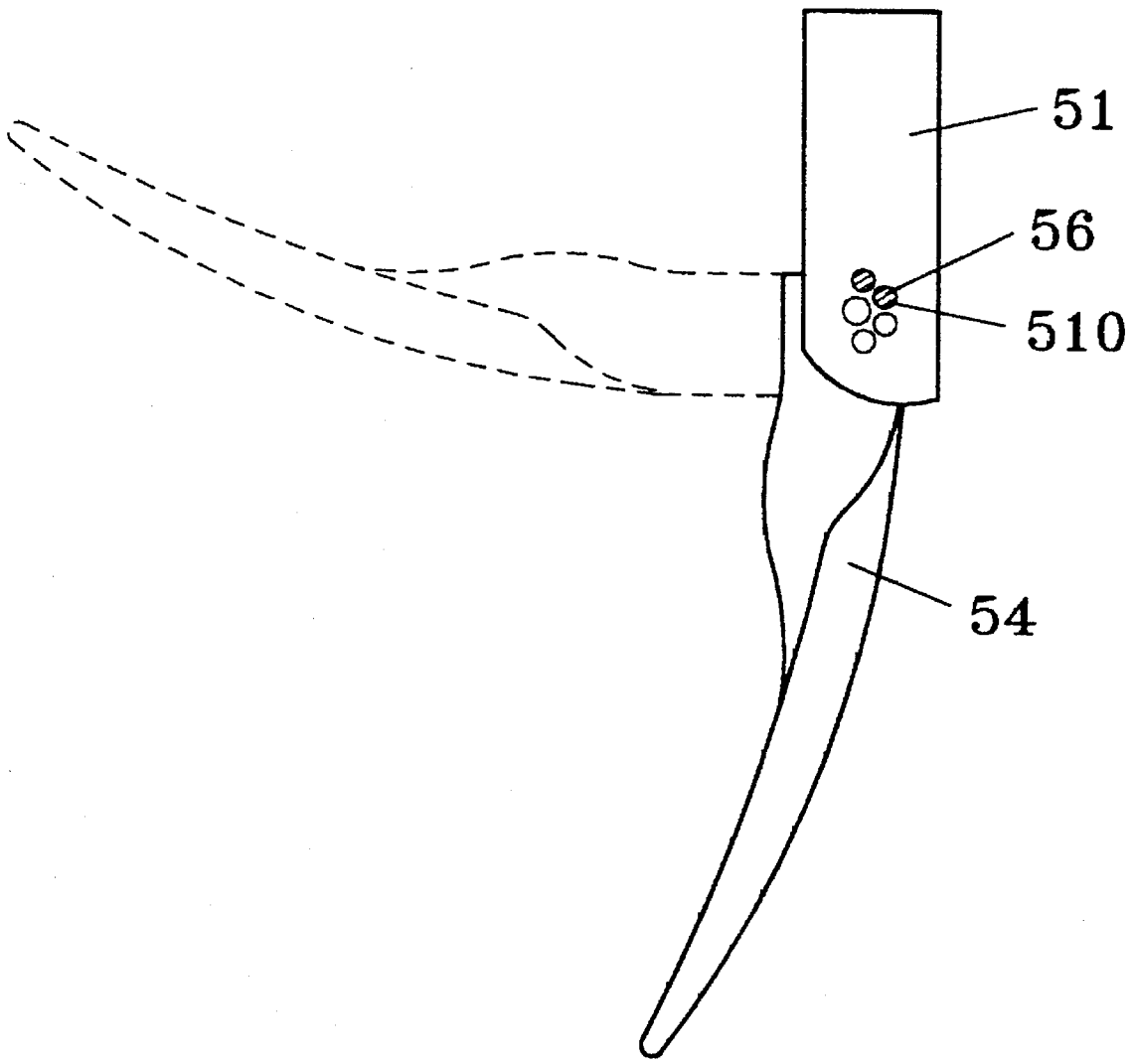

Referring next to FIGS. 5 and 6, a coupler 51 includes a recess 511 formed in the bottom portion, a number of apertures 510 formed therein and includes a stud 512 provided on top thereof for engaging with the bottom end of the extension 30 and secured to the extension 30 by projection means 53 and biasing means 52. A tool, such as a shovel 54 as shown in FIG. 5, includes a root 540 engaged in the recess 511 of the coupler 51 and pivotally coupled to the coupler 51 by projection means 56 and biasing means 55 such that the shovel 54 is rotatable relative to the coupler 51 about the pivot axle formed by the projection means 56 (FIG. 8). A quick coupler means includes a bolt 57 engaged through the root 540 of the shovel 54 and the apertures 510 of the coupler 51 and having an outer thread 570 for engaging with a nut 571 so as to secure the shovel 54 to the coupler 51. The bolt 57 includes a pair of ears 572 provided on one end thereof and having a rod 590 rotatably engaged therein. A washer 58 is engaged on the ears 572 of the bolt 57. A knob 59 is secured to the rod 590 for rotating the rod 590. The rod 590 includes two ends each having a cam 591 eccentrically extended outward therefrom so as to form a cam means. The cams 591 may be engaged with the washer 58 or engaged with the coupler 51 when the knob 59 is rotated in order to force the coupler 51 toward the root 540 of the shovel 54 and so as to secure the shovel 54 in place, best shown in FIG. 7.

Accordingly, the crutch combination in accordance with the present invention includes a crutch having a knife, an axhammer and a shovel that may be secured to the crutch so as to be provided as rescuing tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A crutch combination, comprising:

a longitudinally extended tubular member having opposing upper and lower ends and an open bore extending therebetween, said tubular member having a plurality of longitudinally spaced holes formed through a peripheral wall thereof and in open communication with said bore;

a handle releasably secured to said upper end of said tubular member, said handle having a lower portion extending into said bore of said tubular member, said lower portion having at least one aperture formed therethrough and disposed in aligned relationship with a respective one of said plurality of holes formed in said tubular member, said handle including a knife blade extending from said lower portion into said bore of said tubular member;

first projection means for releasably coupling said handle to said tubular member disposed in said lower portion of said handle, said first projection means extending through a said aperture and said aligned hole of said tubular member and being displaceable therefrom;

an extension tube having an upper end slidably engaged within said bore of said tubular member and a lower end extending from said lower end of said tubular member, said extension tube having a central bore extending between said opposing upper and lower ends thereof and at least one through openings respectively formed adjacent said upper and lower ends of said extension tube;

second projection means for coupling said extension tube to said tubular member disposed in said central bore of said extension tube, said second projection means extending through said through opening adjacent said upper end of said extension tube and a selected one of said plurality of holes of said tubular member and being displaceable therefrom to provide an adjustable and releasable coupling therebetween;

head means releasably coupled to said lower end of said extension tube, said head means including a coupler having a tubular stud formed on an upper end thereof and extending into said central bore of said extension tube, said tubular stud having at least one aperture formed therethrough and positioned in aligned relationship with said through opening formed adjacent said lower end of said extension tube, said head means including third projection means for releasably coupling said coupler to said extension tube disposed in said tubular stud, said third projection means extending through said tubular stud aperture and said through opening adjacent said lower end of said extension tube and being displaceable therefrom, said coupler having a lower end with a recess formed therein, said head means including (1) a tool head pivotally coupled to said coupler within said recess by a bolt, (2) fourth projection means disposed within said tool head for securing said tool head to said coupler, (3) a nut engaged on a first end of said bolt, (4) a rod rotatably engaged to a second end of said bolt, (5) a knob secured to said rod for rotation thereof, and (6) cam means secured to said rod for rotation therewith to engage said coupler to force opposing sides of said recess against said tool head for securement thereof responsive to rotation of said knob.

2. A crutch combination, comprising:

a longitudinally extended tubular member having opposing upper and lower ends end an open bore extending therebetween, said tubular member having a plurality of longitudinally spaced pairs of holes formed through a peripheral wall thereof and in open communication with said bore, each of said pairs of holes being disposed on opposing sides of said tubular member;

a handle releasably secured to said upper end of said tubular member, said handle having a lower portion extending into said bore of said tubular member, said lower portion having a pair of apertures formed through opposing sides thereof and disposed in aligned relationship with a respective one of said pairs of holes formed in said tubular member, said handle including a knife blade fixedly extending outward from said lower portion into said bore of said tubular member;

means for coupling said handle to said tubular member disposed in said lower portion of said handle, said handle coupling means including a pair of first projections disposed on opposing ends of a first spring and positioned in aligned relationship with said pair of apertures, each of said pair of first projections being biased by said first spring member to extend through a respective one of said pair of apertures and a said aligned hole of said tubular member and being displaceable against said first spring bias to provide a releasable coupling therebetween;

an extension tube having an upper end slidably engaged within said bore of said tubular member and a lower end extending from said lower end of said tubular member, said extension tube having a central bore extending between opposing upper and lower ends thereof and a respective pair of through openings formed adjacent said upper and lower ends of said extension tube, each through opening of said pair of through openings being disposed on opposing sides of said extension tube and in open communication with said central bore;

means for coupling said extension tube to said tubular member disposed in said central bore of said extension tube, said extension tube coupling means including a pair of second projections disposed on opposing ends of a second spring and positioned in aligned relationship with said pair of through openings adjacent said upper end of said extension tube, each of said pair of second projections being biased by said second spring member to extend through a respective one of said pair of through openings and a respective hole of a selected pair of said plurality of pairs of holes of said tubular member and being displaceable against said second spring bias to provide an adjustable and releasable coupling therebetween;

a head member releasably coupled to said lower end of said extension tube, said head member having a tubular stud formed on one end thereof and extending into said central bore of said extension tube, said tubular stud having a pair of apertures formed through opposing sides thereof and disposed in aligned relationship with said pair of through opening formed adjacent said lower end of said extension tube and, means for coupling said head member to said extension tube disposed in said tubular stud, said head member coupling means including a pair of third projections disposed on opposing ends of a third spring and positioned in aligned relationship with said pair of apertures formed in said tubular stud, each of said pair of third projections being biased by said third spring member to extend through a respective one of said pair of tubular stud apertures and a respective through opening of said extension tube and being displaceable against said third spring bias to provide a releasable coupling therebetween.

3. The crutch combination as recited in claim 2 where said head member is a tip member.

4. The crutch combination as recited in claim 2 where said head member is an axhammer.

5. The crutch combination as recited in claim 2 where said head member is a shovel.

* * * * *